US008115569B2

(12) United States Patent
Lee et al.

(10) Patent No.: US 8,115,569 B2
(45) Date of Patent: Feb. 14, 2012

(54) MONOBLOCK DIELECTRIC MULTIPLEXER CAPABLE OF PROCESSING MULTI-BAND SIGNALS

(75) Inventors: Kiejin Lee, Seoul (KR); Jong Chel Kim, Seoul (KR); Young Soo Jang, Chungcheongbuk-do (KR)

(73) Assignee: Industry-University Cooperation Foundation Sogang, Seoul (KR)

( * ) Notice: Subject to any disclaimer, the term of this patent is extended or adjusted under 35 U.S.C. 154(b) by 141 days.

(21) Appl. No.: 12/561,727

(22) Filed: Sep. 17, 2009

(65) Prior Publication Data

US 2010/0231324 A1 Sep. 16, 2010

(30) Foreign Application Priority Data

Mar. 16, 2009 (KR) ..... 10-2009-0022134

(51) Int. Cl.
*H01P 1/213* (2006.01)
*H01P 1/202* (2006.01)

(52) U.S. Cl. ..... 333/134; 333/206

(58) Field of Classification Search ..... 333/134, 333/202, 206

See application file for complete search history.

(56) References Cited

U.S. PATENT DOCUMENTS 4,823,098 A * 4/1989 DeMuro et al. ..... 333/206
5,227,747 A * 7/1993 Komazaki et al. ..... 333/206
6,351,195 B1 * 2/2002 Atokawa et al. ..... 333/134
6,448,870 B1 * 9/2002 Hiroshima et al. ..... 333/134
6,696,905 B2 * 2/2004 Umeda et al. ..... 333/206
7,075,388 B2 * 7/2006 Rogozine et al. ..... 333/134
7,321,278 B2 * 1/2008 Vangala ..... 333/134
7,696,845 B2 * 4/2010 Fujinaga et al. ..... 333/202

FOREIGN PATENT DOCUMENTS

WO WO 2006137470 A1 * 12/2006

* cited by examiner

*Primary Examiner* — Seungsook Ham

(74) *Attorney, Agent, or Firm* — Frommer Lawrence & Haug LLP; Ronald R Santucci

(57) ABSTRACT

Disclosed herein is a monoblock dielectric multiplexer capable of processing multi-band signals. The monoblock dielectric multiplexer includes a dielectric block implemented as a hexahedral dielectric forming a body of the monoblock dielectric multiplexer. An external electrode is applied to an external surface of the dielectric block except for to a top surface. Resonant holes are each formed in a cylindrical shape and formed through the top surface and a bottom surface of the dielectric block. Internal electrodes are respectively formed on inner walls of the resonant holes. A plurality of capacitance patterns is formed on the top surface of the dielectric block and is configured to surround corresponding resonant holes. Input/output electrode units are formed and spaced apart from the capacitance patterns and configured to form capacitance coupling to the capacitance patterns. A common antenna stage is formed in a center portion of the dielectric block.

9 Claims, 10 Drawing Sheets

MONOBLOCK DIELECTRIC MULTIPLEXER CAPABLE OF PROCESSING MULTI-BAND SIGNALS

This application claims priority benefits to Korean Patent Application No. 10-2009-0022134 filed Mar. 16, 2009, the disclosure of which is hereby incorporated by reference.

BACKGROUND OF THE INVENTION

1. Field of the Invention

The present invention relates, in general, to a multiplexer having a monoblock dielectric structure capable of processing multi-band signals, and, more particularly, to a multiplexer which has a monoblock dielectric structure capable of transmitting and receiving signals composed of various band components through a common antenna by extending a duplexer that performs transmission and reception through a single antenna.

2. Description of the Related Art

With the development of communication technology, the use of mobile communication terminals exploiting various frequencies has rapidly increased, and the use of high frequencies for mobile communication has gradually increased to improve the type and quality of services provided by mobile communication terminals.

Recent mobile communication technologies are classified into first, second and third generation technologies according to the amount and type of content that can be transmitted. Various high frequencies have been used for a variety of types of services such as Wireless Broadband Internet (Wibro) enabling the fast Internet to be used while moving from place to place.

Generally, a duplexer is a principal part of a mobile communication terminal, and provides a function of passing therethrough only signals of a specific frequency band of a transmission filter and a reception filter, via a combined transmission (TX)/reception (RX) antenna. Duplexers may be classified into various types, but require the realization of a small size and a light weight as essential conditions so as to improve the portability of mobile communication terminals. In order to satisfy these conditions, monoblock dielectric duplexers have been widely used.

Such a monoblock dielectric duplexer is designed such that a plurality of resonant holes forms the filters of TX/RX stages on a dielectric block and the frequency characteristics of the filters are exhibited by conductive patterns around the holes. Such a monoblock dielectric duplexer is advantageous in that a process for manufacturing the duplexer can be simplified, can be easily implemented and can be designed to have a small size. However, a monoblock dielectric duplexer is disadvantageous in that, since it is used only in a single frequency band, duplexers having different frequency bands must be used in multiple bands, so that the size of the system increases and the number of processes used to manufacture the duplexer increases, thus increasing the costs of manufacturing the system.

Furthermore, such a conventional monoblock dielectric duplexer is problematic in that, when band-pass filters having different frequency processing bands are used to process multi-band signals, an E-H field formed in a first band-pass filter is not transferred to a subsequent band, thus making it impossible to increase the number of channels that can be processed.

SUMMARY OF THE INVENTION

Accordingly, the present invention has been made keeping in mind the above problems occurring in the prior art, and an object of the present invention is to provide a monoblock dielectric multiplexer capable of processing multi-band signals, in which a filter coupled to a common antenna stage is implemented as a band-stop filter, so that a signal can be transferred to a subsequent stage, thus enabling a multiplexer capable of processing multi-band signals to be implemented in a dielectric monoblock, and in which patterns are formed on the top surface of a dielectric to improve attenuation characteristics in low frequency and high frequency bands, thus improving ripple characteristics close to equiripples.

In order to accomplish the above object, the present invention provides a monoblock dielectric multiplexer, comprising a dielectric block implemented as a hexahedral dielectric forming a body of the monoblock dielectric multiplexer; an external electrode applied to an external surface of the dielectric block except for to a top surface of the dielectric block; a plurality of resonant holes, each formed in a cylindrical shape and formed through the top surface and a bottom surface of the dielectric block; internal electrodes respectively formed on inner walls of the resonant holes; a plurality of capacitance patterns formed on the top surface of the dielectric block and configured to surround corresponding resonant holes; coupling patterns formed between the capacitance patterns and spaced apart from each other by a predetermined distance, first ends of the coupling patterns being formed to come into contact with the external electrode; input/output electrode units formed and spaced apart from the capacitance patterns and configured to form capacitance coupling to the capacitance patterns, the input/output electrode units extending from the top surface to a front surface of the dielectric block and inputting and outputting signals; and a common antenna stage formed in a center portion of the dielectric block, wherein some of the patterns formed on the top surface of the dielectric block form patterns of at least one band-stop filter coupled to the antenna stage.

Preferably, the resonant holes are arranged in parallel to each other, and perform resonance in a ¼ Transverse Electro Magnetic (TEM) mode.

Preferably, the coupling patterns are formed in shapes of strip patterns between the capacitance patterns.

Preferably, among the capacitance patterns and the coupling patterns, patterns other than patterns forming the patterns of the band-stop filter form a band-pass filter coupled to the band-stop filter at both ends of the patterns of the band-stop filter.

Preferably, among the input/output electrode units, input/output electrode units for inputting and outputting signals to and from the band-stop filter are connected to each other through a bar-type pattern which is formed and spaced apart from the capacitance patterns forming the patterns of the band-stop filter by a predetermined distance which forms capacitance coupling.

Preferably, among the coupling patterns, coupling patterns forming the patterns of the band-stop filter are coupling inductance patterns.

In addition, the present invention provides a monoblock dielectric multiplexer, the multiplexer being configured such that a top surface of a dielectric block forming a body of the monoblock dielectric multiplexer is set as an open surface, an external electrode is formed to be applied to an external surface of the dielectric block except for to the open surface, and the multiplexer comprises a plurality of resonant holes formed through the open surface and a bottom surface of the dielectric block and internal electrodes respectively formed on inner walls of the resonant holes, comprising a first duplexer including a plurality of capacitance patterns surrounding resonant holes formed in a left half portion of the dielectric block, and coupling patterns formed between the respective capacitance patterns and spaced apart from each other by a predetermined distance, first ends of the coupling patterns being formed to come into contact with the external electrode; a second duplexer including a plurality of capacitance patterns surrounding resonant holes formed in a right half portion of the dielectric block, and coupling patterns formed between the respective capacitance patterns and spaced apart from each other by a predetermined distance, first ends of the coupling patterns being formed to come into contact with the external electrode; a common antenna stage provided at a junction between the first and second duplexers; and input/output electrode units configured to input and output signals to and from the respective first and second duplexers.

Preferably, the first and second duplexers comprise patterns of band-stop filters coupled to the common antenna stage.

Preferably, among the coupling patterns, coupling patterns forming the patterns of the band-stop filters are coupling inductance patterns.

Preferably, among the input/output electrode units, input/output electrode units for inputting and outputting signals to and from the band-stop filters are connected to each other through a bar-type pattern which is formed and spaced apart from capacitance patterns forming the patterns of the band-stop filters by a predetermined distance and which forms capacitance coupling.

Preferably, the input/output electrode units are formed and spaced apart from the capacitance patterns by a specific distance to form capacitance coupling to the capacitance patterns, and are formed to extend from the top surface to a front surface of the dielectric block.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, embodiments of a monoblock dielectric multiplexer capable of processing multi-band signals according to the present invention will be described in detail with reference to the attached drawings.

Figure 1A:
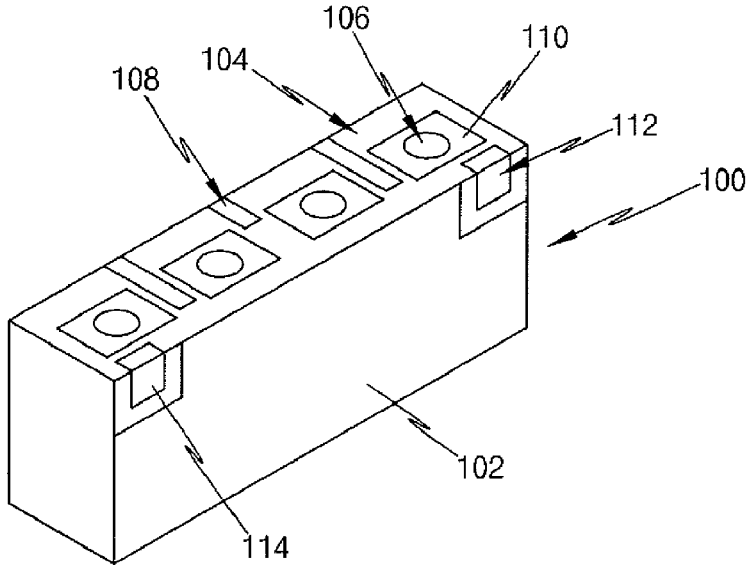
FIG. 1A is a perspective view showing the band-pass filter of a 2G duplexer constituting a monoblock dielectric multiplexer according to an embodiment of the present invention.
Figure 1B:
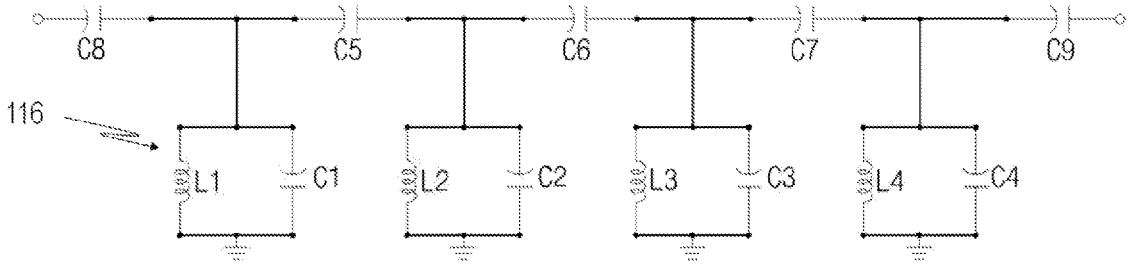
FIG. 1B is a circuit diagram showing the equivalent circuit of the band-pass filter of FIG. 1A.
Figure 1C:
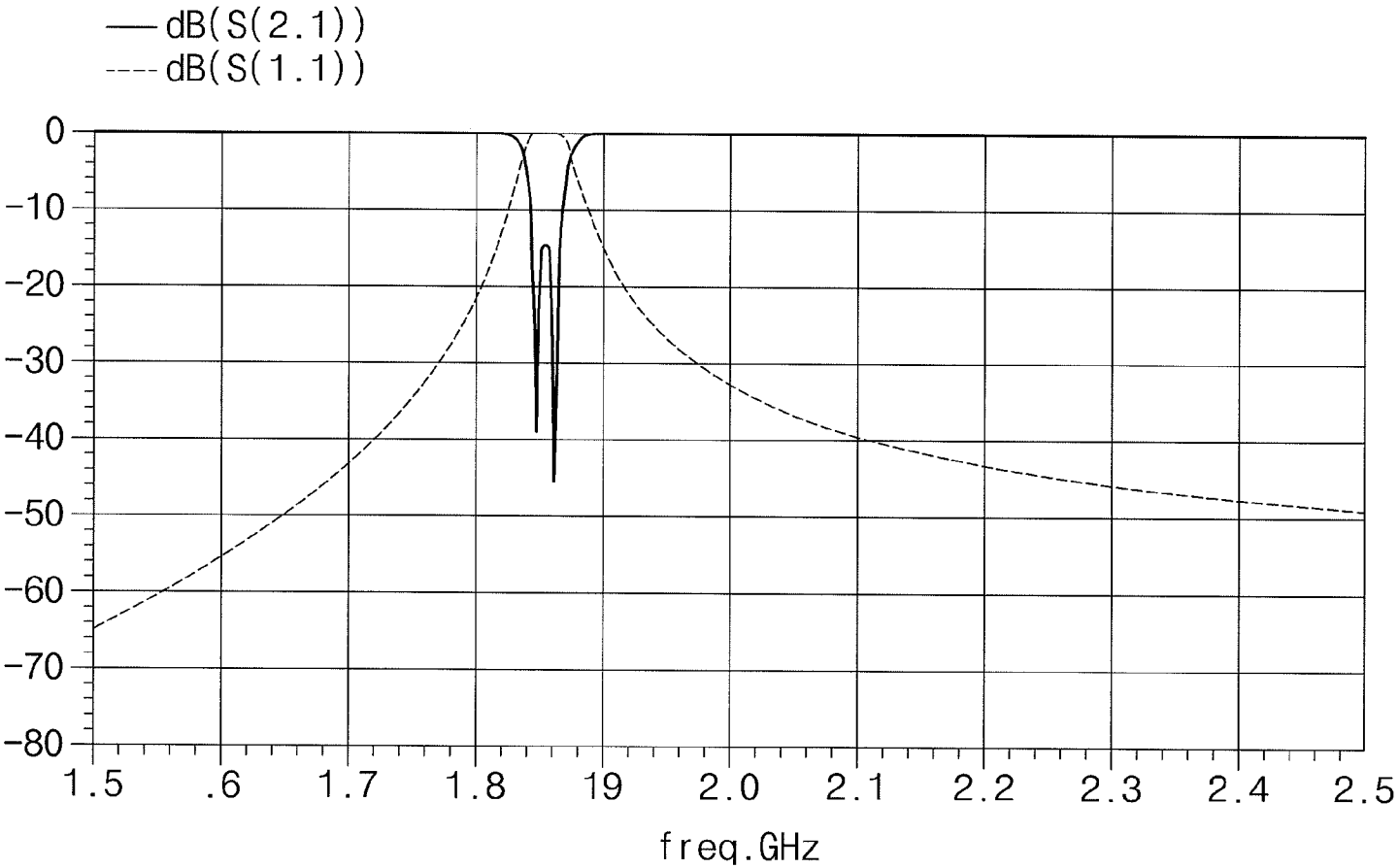
FIG. 1C is a graph showing the transmission and reflection characteristics of the band-pass filter of FIG. 1A.

FIG. 1A is a perspective view showing the band-pass filter of a duplexer for second generation technology (hereinafter referred to as a '2G duplexer') constituting a monoblock dielectric multiplexer according to an embodiment of the present invention, FIG. 1B is a circuit diagram showing the equivalent circuit of the band-pass filter of FIG. 1A, and FIG. 1C is a graph showing the transmission and reflection characteristics of the band-pass filter of FIG. 1A.

The band-pass filter 100 of a 2G duplexer constituting a monoblock dielectric multiplexer according to an embodiment of the present invention includes a dielectric block, an external electrode 102, resonant holes 106, capacitance patterns 110, coupling patterns 108, and input/output electrode units 112 and 114. The dielectric block forms a body of the duplexer and has a hexahedral shape. The external electrode 102 is applied to the external surface of the dielectric block, except for to the top surface 104 thereof. The resonant holes 106 are formed through the top and bottom surfaces of the dielectric block. The capacitance patterns 110 are formed to surround the resonant holes 106. The coupling patterns 108 are formed between respective capacitance patterns 110 and spaced apart from each other by a predetermined distance. The input/output electrode units 112 and 114 function to input and output signals to and from the duplexer and are formed to extend from the top surface to the front surface of the dielectric block.

The band-pass filter 100 of the 2G duplexer according to the present invention is implemented as a monoblock ceramic dielectric filter. The band-pass filter 100 is configured such that a plurality of resonant holes 106 is formed in the dielectric block and internal electrodes for the internal conductors of a coaxial cable are formed on the inner walls of the resonant holes 106, and such that a conductor is applied to the external surface of the dielectric block, except for to the top surface 104, and is used as the external electrode 102. The external electrode 102 and one resonant hole 106 in which one internal electrode is formed constitute a single resonator, and the coupling between respective resonators is formed by a dielectric located between resonant holes. The resonant holes formed in the dielectric block respectively perform resonance in a ¼ wavelength Transverse Electro Magnetic (TEM) mode, and constitute a dielectric filter having unique attenuation characteristics through mutual coupling.

The monoblock dielectric filter according to an embodiment of the present invention adjusts the pass band and stop band of a band-pass filter included in the 2G duplexer by adjusting the permittivity of a dielectric constituting the capacitance patterns 110, the coupling patterns 108 and the dielectric blocks, and the diameters and lengths of the resonant holes.

The external electrode 102 formed on the external surface of the dielectric block except for the top open surface thereof, and the resonant holes 106, including the internal electrodes formed on the inner walls of the resonant holes 106, function as devices 116, each composed of an inductor and a capacitor, in the equivalent circuit of FIG. 1B, and such a device 116 is connected to the ground and has a unique resonant frequency.

The band-pass filter 100 of the 2G duplexer according to the present invention may further include strip-shaped coupling patterns 108. Such a strip-shaped coupling pattern is connected to the external electrode 102 at one end thereof, is disposed between the resonant holes 106, thus functioning as an attenuation device for allowing part of signals coupled between the respective resonant holes 106 to flow into the ground through the external electrode 102. High frequency and low frequency characteristics can be improved by adjusting the capacitance coupling between the resonant holes 106 through the coupling patterns 108. These characteristics are desirably shown in FIG. IC in which a curve represented by a solid line indicates transmission characteristics (S(2, 1)), and a curve represented by a dotted line indicates reflection characteristics (S(1, 1)). It can be seen that the slopes of a high frequency portion and a low frequency portion of a pass band in the solid-line curve, that is, skirt characteristics, are very excellent.

The top surface of the dielectric block is an open surface and is configured such that patterns for extracting only a desired band are formed thereon. The band-pass filter 100 of the 2G duplexer according to the present invention may include the capacitance patterns 110, each forming capacitance coupling to the pattern of an adjacent resonant hole 106 while surrounding the resonant hole 106, and the coupling patterns 108 disposed between the capacitance patterns 110 and spaced apart from each other by a predetermined distance. The coupling patterns 108 are formed in the shape of strips, one end of each of which is connected to the external electrode 102, and are connected to the ground to function as attenuation devices, as described above. The coupling patterns 108 may be represented by capacitors or inductors on the equivalent circuit, which may differ depending on the specification of a filter. In this case, the capacitance or inductance values of the capacitors or inductors are determined by the area or length of strip patterns, and are suitably adjusted according to the pass band.

The capacitance patterns 110 and the coupling patterns 108 constituting the band-pass filter of the 2G duplexer according to the present invention may provide a filter having excellent skirt characteristics in the transmission characteristics of a high-frequency band or a low-frequency band, and may improve ripple characteristics close to equiripples because ripple components are not increased with the increase in an order. That is, by adjusting the mutual coupling between the resonant holes 106 using the coupling patterns, the skirt characteristics of high-frequency and low-frequency bands can be improved without requiring the use of attenuation poles. This is desirably shown in the graph of FIG. 1C illustrating transmission and reflection characteristics, and it can be seen that skirt characteristics are excellent because a curve for coupling a transmission band to an attenuation band in the graph is formed in a shape close to a vertical line.

The input/output electrode units 112 and 114 input and output signals to and from the band-pass filter, are formed to extend from the top surface to the front surface of the dielectric block, and are configured to form capacitance coupling to the capacitance patterns 110.

Figure 2A:
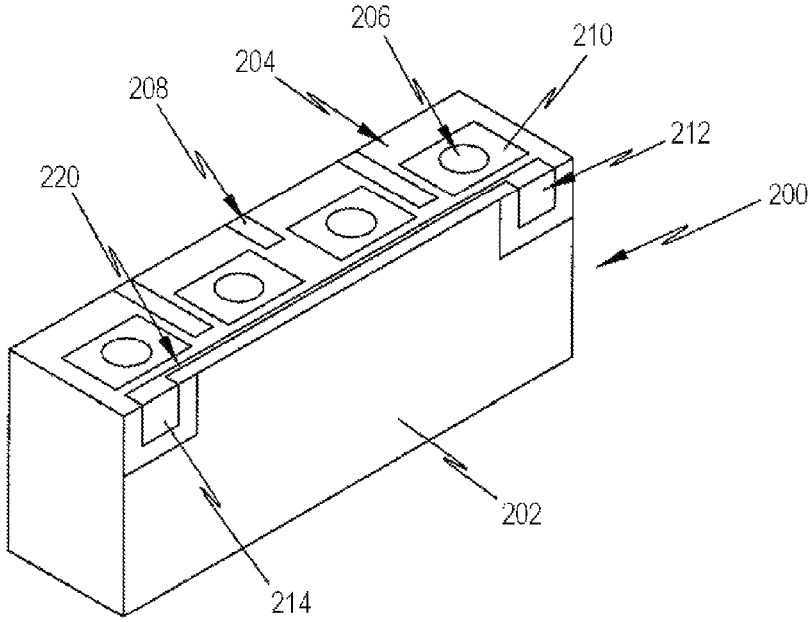
FIG. 2A is a perspective view showing the band-stop filter of a 2G duplexer constituting a monoblock dielectric multiplexer according to an embodiment of the present invention.
Figure 2B:
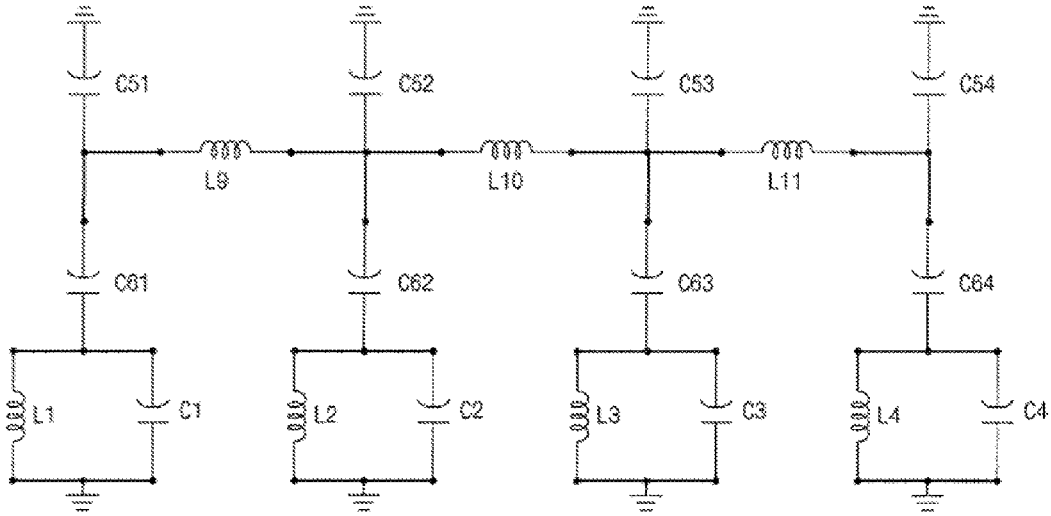
FIG. 2B is a circuit diagram showing the equivalent circuit of the band-stop filter of FIG. 2A.

FIG. 2A is a perspective view showing the band-stop filter of a 2G duplexer constituting a monoblock dielectric multiplexer according to an embodiment of the present invention. Similarly to the band-pass filter 100 of FIG. 1A, the band-stop filter 200 of the 2G multiplexer includes a dielectric block, an external electrode 202, resonant holes 206, capacitance patterns 210, coupling patterns 208, and input/output electrode units 212 and 214. The dielectric block forms a body of the duplexer and has a hexahedral shape. The external electrode 202 is applied to the external surface of the dielectric block, except for to the top surface 204 thereof. The resonant holes 206 are formed through the top and bottom surfaces of the dielectric block. The capacitance patterns 210 are formed to surround the resonant holes 206. The coupling patterns 208 are formed between respective capacitance patterns 210 and spaced apart from each other by a predetermined distance. The input/output electrode units 212 and 214 function to input and output signals to and from the duplexer and are formed to extend from the top surface to the front surface of the dielectric block.

Similarly to the band-pass filter 100 of FIG. 1A, the band-stop filter 200 of FIG. 2A is implemented as a band-stop filter 200 for stopping a specific band through the capacitance patterns 210 and the coupling patterns 208, which are formed on the top surface 204, that is, an open surface, and the resonant holes 206.

Figure 2C:
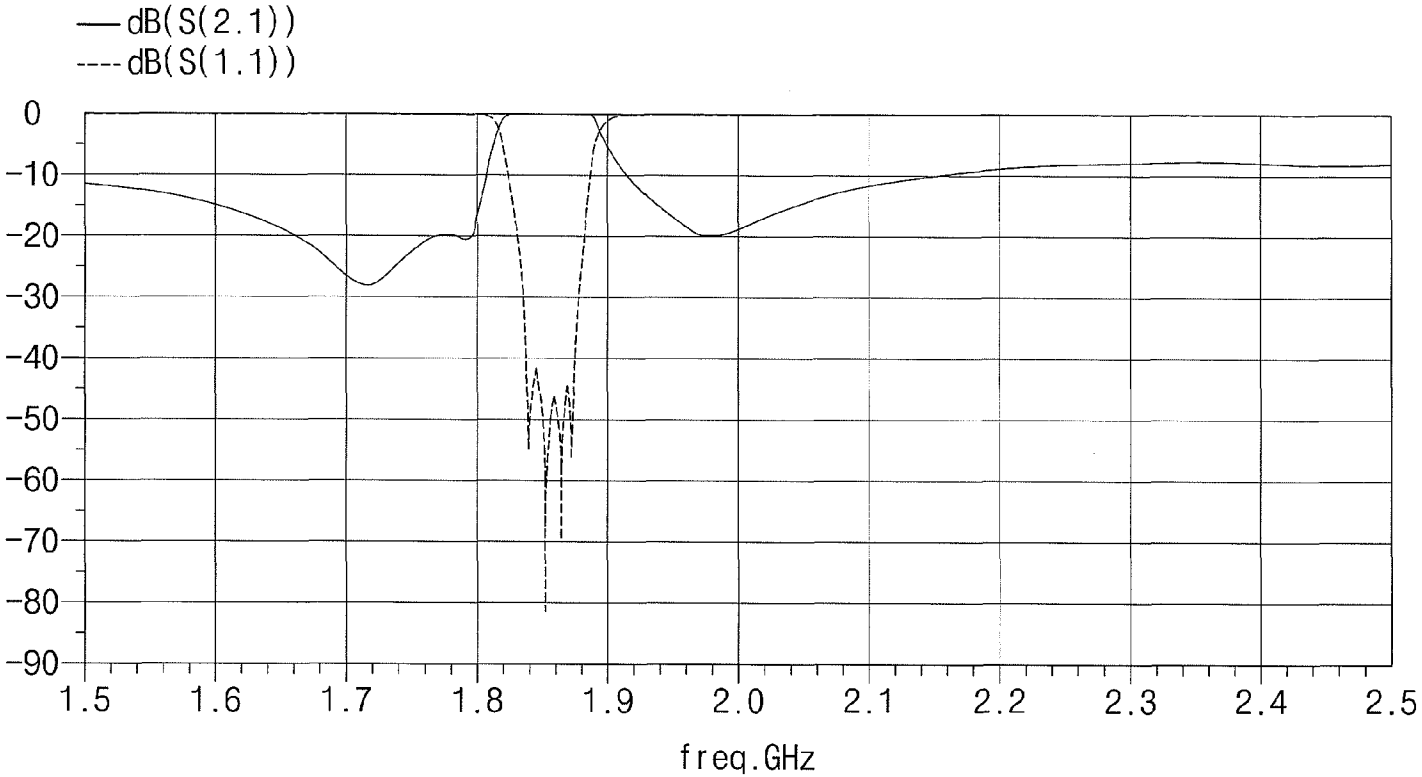
FIG. 2C is a graph showing the transmission and reflection characteristics of the band-stop filter of FIG. 2A.

As shown in the perspective view of FIG. 2A, the band-stop filter 200 of the 2G duplexer according to the present invention is configured such that the input/output electrode units 212 and 214 are connected to each other through a bar-type pattern 220 forming capacitance coupling to the respective resonant holes 206, thus transmitting the E-H field of a signal input through the bar-type pattern 220 to a band-pass filter in a subsequent stage while exhibiting the characteristics of the band-stop filter through the coupling to the resonant holes 206. A conventional duplexer has a problem in that, since the E-H field is not desirably transferred, several monoblock duplexers required to process respective band signals must be installed so as to process multi-band signals, thus resulting in spatial limitations and an increase in manufacturing costs. In contrast, the band-stop filter 200 according to the present invention can transfer an input E-H field to a subsequent stage, thus enabling a plurality of duplexers to be implemented as a monoblock structure. Furthermore, as shown in thetransmission characteristic curve (S(2,1 )) of FIG. 2C, it canbe seen that skirt characteristics in high-frequency and low-frequency portions of the stop band are very excellent.

Figure 3A:
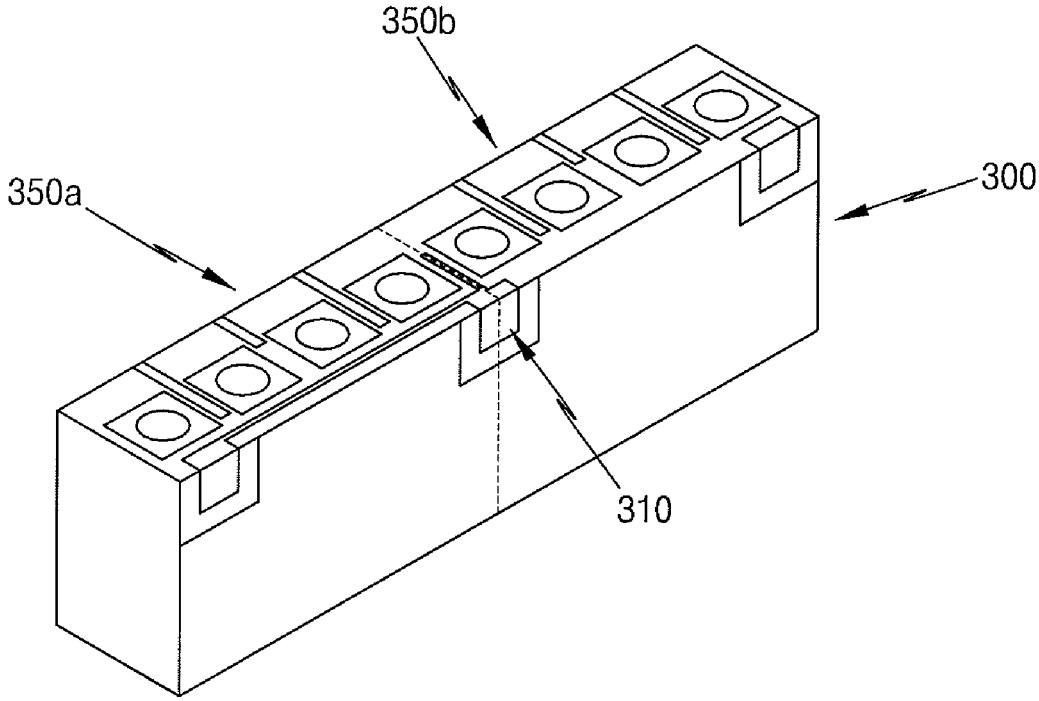
FIG. 3A is a perspective view showing a 2G duplexer constituting a monoblock dielectric multiplexer according to an embodiment of the present invention.

FIG. 3A is a perspective view showing a 2G duplexer according to the present invention. A 2G duplexer 300 according to the present invention may be divided into a band-stop filter 350*a* and a band-pass filter 350*b*.

The band-stop filter 350*a* and the band-pass filter 350*b* share an input electrode unit 310 with each other, and are designed to have infinite impedance between the band-stop filter 350*a* and the band-pass filter 350*b* through suitable impedance matching. That is, when the band-stop filter 350*a* is used as a reception signal processing unit, and the band-pass filter 350*b* is used as a transmission signal processing unit, the stop band of the band-stop filter 350*a* is a band used by the transmission signal processing unit, and the stop band of the band-pass filter 350*b* is a band used by the reception signal processing unit. However, due to the structure of the patterns of the band-pass filter 350*b*, if a band-pass filter is subsequently disposed in a subsequent stage, an E-H field initially formed in the band-pass filter 350*b* is not transferred to the subsequent stage, and thus it is impossible to increase the number of channels. Accordingly, the present invention is configured such that the band-stop filter 350*a* is disposed between an antenna stage and the band-pass filter 350*b* to constitute a multiplexer, and signals are transferred to the band-pass filter 350*b* through the multiplexer, thus enabling multi-band signals to be processed in the monoblock dielectric structure. That is, the input/output stages of the band-stop filter 350*a* are connected to each other through a bar-type pattern forming capacitance coupling to the capacitance patterns 210 formed around the resonant holes 206. Therefore, input signals can be transferred to the subsequent stage, thus enabling multi-band signals to be processed.

Figure 3B:
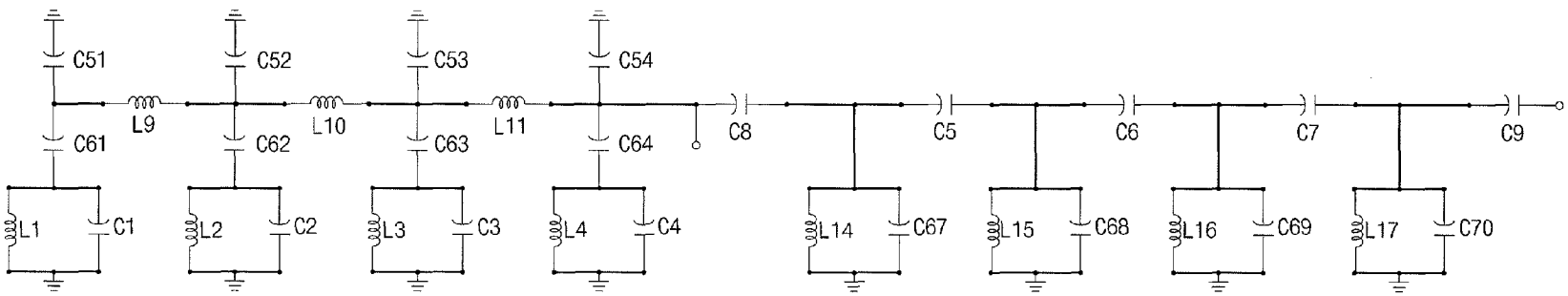
FIG. 3B is a circuit diagram showing the equivalent circuit of the 2G duplexer of FIG. 3A.
Figure 3C:
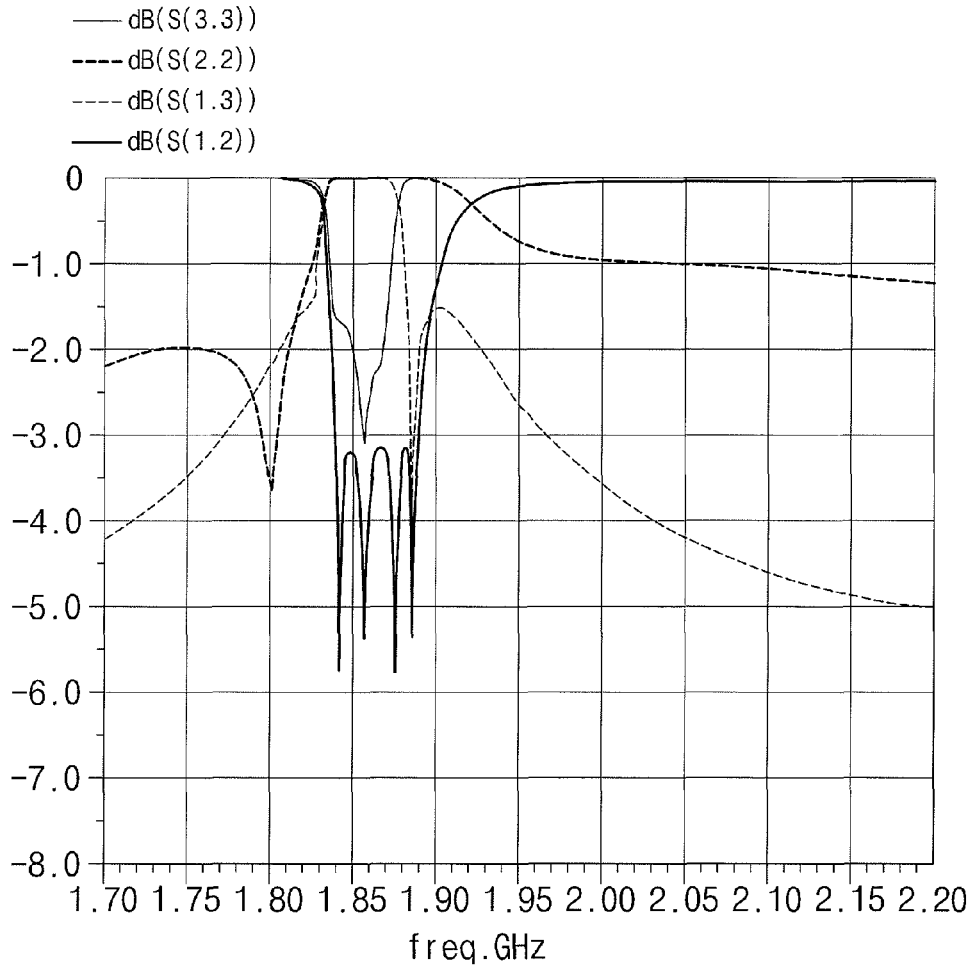
FIG. 3C is a graph showing the transmission and reflection characteristics of the 2G duplexer of FIG. 3A.

FIGS. 3B and 3C are respectively a circuit diagram of the equivalent circuit of the 2G duplexer of FIG. 3A and a graph showing the transmission and reflection characteristics of the 2G duplexer. It can be seen that skirt characteristics in low frequency and high frequency bands are very excellent and the characteristics of equiripples are exhibited.

Figure 4A:
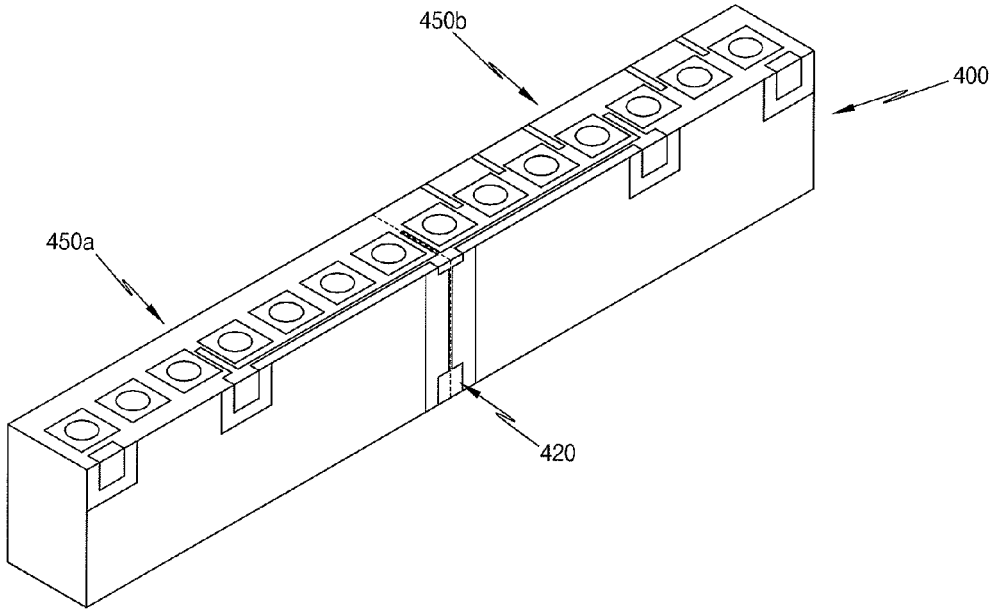
FIG. 4A is a perspective view showing a monoblock dielectric multiplexer according to an embodiment of the present invention.

FIG. 4A is a perspective view showing a monoblock dielectric multiplexer according to an embodiment of the present invention. A monoblock dielectric multiplexer 400 includes a 2G duplexer 450*b* and a duplexer for third generation technology (hereinafter referred to as a '3G duplexer') 450*a*.

The input stages of the 2G duplexer 450*b* and the 3G duplexer 450*a* are connected to a common antenna stage 420, so that signals are input and output through the common antenna stage. The common antenna stage 420 is formed to extend to the bottom surface of the multiplexer so as to simplify circuit construction which is provided to input and output signals in the input/output stages of respective duplexers.

The 2G duplexer 450*b* and the 3G duplexer 450*a* are designed such that very large impedance is matched therebetween in order to prevent respective output signals from being transferred to opposite units. A band-stop filter is primarily connected to the common antenna stage so that signals are transferred to a band-pass filter in a subsequent stage. Of course, the multiplexer 400 of FIG. 4A is a multiplexer in which two band-stop filters are coupled to the common antenna stage, and four channels having two bands are formed. However, it is also apparent that a triplexer may be implemented by omitting any one band-stop filter and using only a single band-stop filter.

Figure 4B:
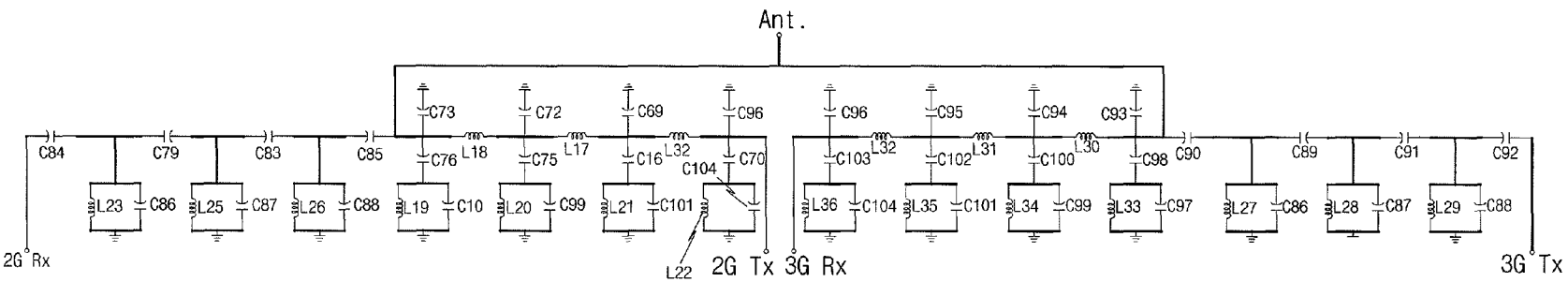
FIG. 4B is a circuit diagram showing the equivalent circuit of the monoblock dielectric multiplexer of FIG. 4A.

FIG. 4B is a circuit diagram showing the equivalent circuit of the multiplexer of FIG. 4A. The multiplexer is formed such that a common input stage for the 2G duplexer and the 3G duplexer is connected to the common antenna stage 420. The multiplexer capable of processing multi-band signals according to the present invention is configured such that band-stop filters coupled to the common antenna stage 420 are disposed on the left and right sides of the common antenna stage 420, thus enabling signals input to or output from the common antenna stage 420 to be transferred to the band-pass filters in the subsequent stages.

Figure 4C:
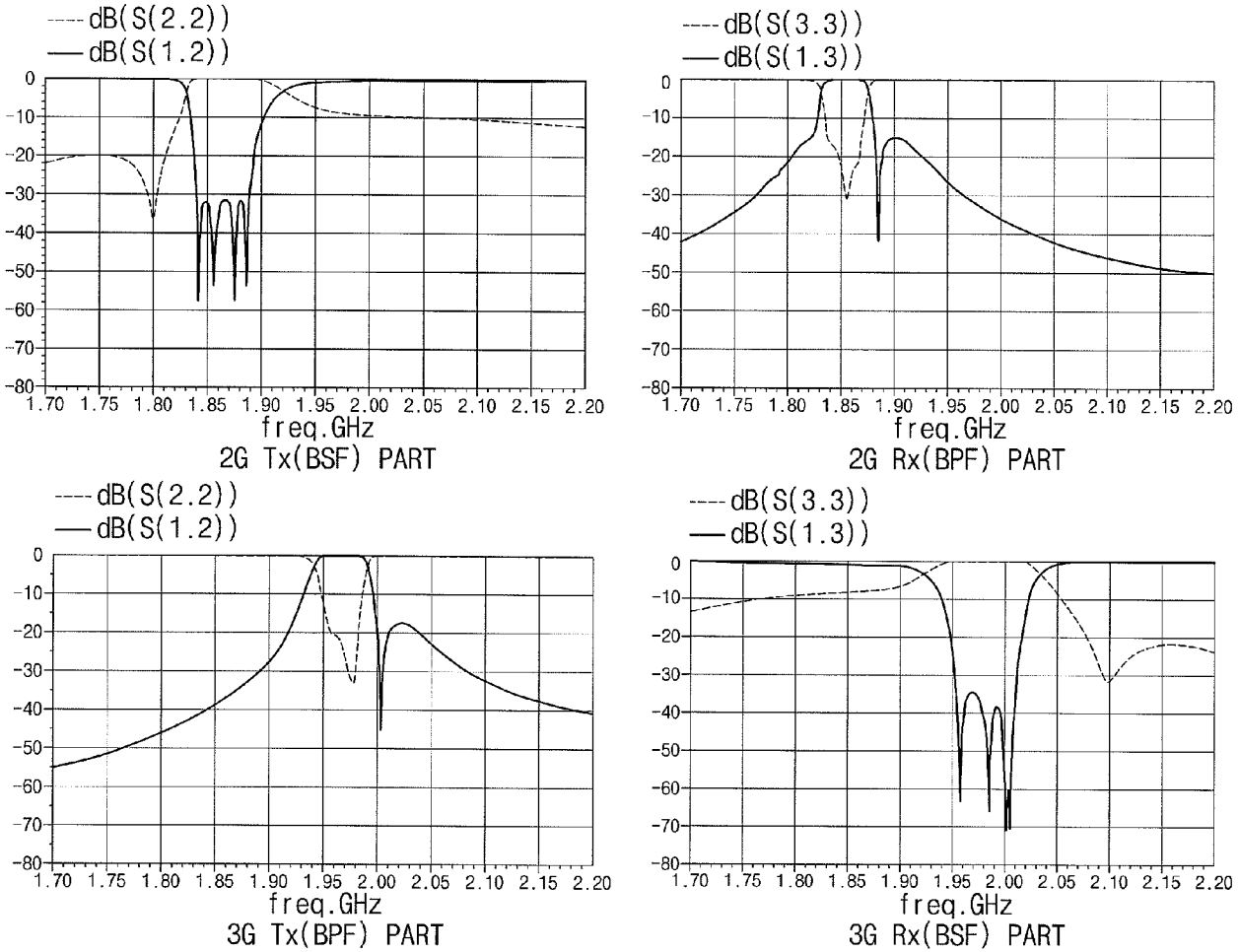
FIG. 4C is a graph showing the transmission and reflection characteristics of the monoblock dielectric multiplexer of FIG. 4A.

FIG. 4C is a graph showing the transmission characteristics of respective filters included in the multiplexer of FIG. 4A, wherein the entire transmission characteristics of the multiplexer are divided into respective parts and separately shown. Referring to the graph of FIG. 4C, it can be seen that the skirt characteristics of the respective filters are very excellent.

As described above, the present invention provides a multiplexer capable of processing multi-band signals, which is advantageous in that, since the multiplexer is implemented using a monoblock dielectric, various duplexers which process multiple bands are implemented as a single monoblock structure, without various duplexers which process multiple bands being separately provided, in a communication environment in which various bands have recently been utilized, thus realizing the small size and low cost of the system.

Accordingly, the present invention having the above construction is advantageous in that a multiplexer capable of processing multi-band signals can be implemented in a dielectric monoblock.

Further, the present invention is advantageous in that, as a multi-band structure is implemented in a dielectric monoblock, communication devices can be designed to have a small size and a compact structure, and the increase in the manufacturing costs and in the interference between respective duplexers attributable to the installation of a plurality of duplexers can be eliminated.

Furthermore, the present invention is advantageous in that patterns are formed on the top surface of a dielectric to improve attenuation characteristics in low frequency and high frequency bands, thus improving ripple characteristics close to equiripples.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A monoblock dielectric multiplexer, comprising:

a dielectric block implemented as a hexahedral dielectric forming a body of the monoblock dielectric multiplexer;

an external electrode applied to an external surface of the dielectric block except for to a top surface of the dielectric block;

a plurality of resonant holes, each formed in a cylindrical shape and formed through the top surface and a bottom surface of the dielectric block;

internal electrodes respectively formed on inner walls of the resonant holes;

a plurality of capacitance patterns formed on the top surface of the dielectric block and configured to surround corresponding resonant holes;

input/output electrode units formed and spaced apart from the capacitance patterns and configured to form capacitance coupling to the capacitance patterns, the input/output electrode units extending from the top surface to a front surface of the dielectric block and inputting and outputting signals; and a common antenna stage formed in a center portion of the dielectric block, wherein some of the patterns formed on the top surface of the dielectric block form patterns of at least one band-stop filter coupled to the common antenna stage:

wherein, among the input/output electrode units, input/output electrode units for inputting and outputting signals to and from the band-stop filter are connected to each other through a bar-type pattern which is formed and spaced apart from the capacitance patterns forming the patterns of the band-stop filter by a predetermined distance which forms capacitance coupling;

wherein, among the capacitance patterns and the coupling patterns, patterns other than patterns forming the patterns of the band-stop filter form a band-pass filter coupled to the patterns of the band-stop filter, wherein the band-stop filter and the band-pass filter share one of the input/output electrode units with each other and are designed to have infinite impedance between the band-stop filter and the band-pass filter through suitable impedance matching.

2. The monoblock dielectric multiplexer according to claim 1, wherein the resonant holes are arranged in parallel to each other, and perform resonance in a ¼ Transverse Electro Magnetic (TEM) mode.

3. The monoblock dielectric multiplexer according to claim 1, further comprising coupling patterns formed between the capacitance patterns and spaced apart from each other by a predetermined distance, first ends of the coupling patterns being formed to come into contact with the external electrode.

4. The monoblock dielectric multiplexer according to claim 3, wherein the coupling patterns are formed in shapes of strip patterns between the capacitance patterns.

5. The monoblock dielectric multiplexer according to claim 4, wherein among the coupling patterns, coupling patterns forming the patterns of the band-stop filter are coupling inductance patterns.

6. The monoblock dielectric multiplexer according to claim 3, wherein, among the capacitance patterns and the coupling patterns, patterns other than the patterns forming the patterns of the at least one band-stop filter form at least a second band-pass filter coupled to the at least one band-stop filter at both ends of the patterns of the at least one band-stop filter.

7. A monoblock dielectric multiplexer, the multiplexer being configured such that a top surface of a dielectric block forming a body of the monoblock dielectric multiplexer is set as an open surface, an external electrode is formed to be applied to an external surface of the dielectric block except for to the open surface, and the multiplexer comprises a plurality of resonant holes formed through the open surface and a bottom surface of the dielectric block and internal electrodes respectively formed on inner walls of the resonant holes, comprising:

a first duplexer including a plurality of capacitance patterns surrounding resonant holes formed in a left half portion of the dielectric block, and coupling patterns formed between the respective capacitance patterns and spaced apart from each other by a predetermined distance, first ends of the coupling patterns being formed to come into contact with the external electrode;

a second duplexer including a plurality of capacitance patterns surrounding resonant holes formed in a right half portion of the dielectric block, and coupling patterns formed between the respective capacitance patterns and spaced apart from each other by a predetermined distance, first ends of the coupling patterns being formed to come into contact with the external electrode;

a common antenna stage provided at a junction between the first and second duplexers; and input/output electrode units configured to input and output signals to and from the respective first and second duplexers; wherein each of the first and second duplexers have a band-stop filter coupled to the common antenna stage;

wherein, among the input/output electrode units, input/output electrode units for inputting and outputting signals to and from each of the band-stop filters are connected to each other through a bar-type pattern which is formed and spaced apart from the capacitance patterns forming the patterns of the corresponding band-stop filter by a predetermined distance which forms capacitance coupling;

wherein, among the capacitance patterns and the coupling patterns, patterns other than patterns forming the patterns in each of the band-stop filters form a band-pass filter coupled to the patterns of the corresponding band-stop filter, wherein the corresponding band-stop filter and the corresponding band-pass filter share one of the input/output electrode units with each other and are designed to have infinite impedance between the corresponding band-stop filter and the corresponding band-pass filter through suitable impedance matching.

8. The monoblock dielectric multiplexer according to claim 7, wherein coupling patterns of each of the band-stop filters are coupled to the common antenna stage.

9. The monoblock dielectric multiplexer according to claim 8, wherein, among the coupling patterns, coupling patterns forming the patterns of the band-stop filters are coupling inductance patterns.

* * * * *